United States Patent [19]

Harris et al.

[11] Patent Number: 4,485,890

[45] Date of Patent: Dec. 4, 1984

[54] ENGINE EXHAUST MUFFLER

[76] Inventors: Theodore R. Harris, 14 El Patio, Orinda, Calif. 94563; Richard T. Harris, 3127 Stanley Boulevard, Lafayette, Calif. 94549

[21] Appl. No.: 509,992

[22] Filed: Jun. 30, 1983

[51] Int. Cl.[3] ..... F01N 1/12

[52] U.S. Cl. ..... 181/280

[58] Field of Search ..... 181/279, 252, 265, 268, 181/280, 272, 255, 264, 281

[56] References Cited

U.S. PATENT DOCUMENTS

| | | | |
|---|---|---|---|
| 1,612,584 | 12/1926 | Hunter et al. | 181/279 |
| 3,235,003 | 2/1966 | Smith | 165/135 |
| 3,393,767 | 7/1968 | Monk | 181/67 |
| 3,963,092 | 6/1976 | Soares | 181/44 |
| 4,050,539 | 9/1977 | Kashiwara | 181/280 |
| 4,109,753 | 8/1978 | Lyman | 181/252 |
| 4,140,204 | 2/1979 | Wilson | 181/265 |
| 4,165,798 | 8/1979 | Martinez | 181/268 |
| 4,317,502 | 3/1982 | Harris et al. | 181/280 |

FOREIGN PATENT DOCUMENTS

| | | | |
|---|---|---|---|
| 23743 | 8/1936 | Australia | 181/280 |
| 1301824 | 8/1969 | Fed. Rep. of Germany | 181/280 |
| 804593 | 8/1936 | France . | |
| 1087417 | 8/1954 | France . | |
| 641878 | 7/1962 | Italy | 181/280 |
| 266706 | 3/1928 | United Kingdom . | |
| 297871 | 10/1928 | United Kingdom | 181/280 |
| 426847 | 4/1935 | United Kingdom . | |

*Primary Examiner*—Michael L. Gellner
*Assistant Examiner*—Brian W. Brown
*Attorney, Agent, or Firm*—James R. Cypher

[57] ABSTRACT

A muffler for internal combustion engines in which the structure cancels sound waves by interference. The gases generally flow in one direction through the muffler with intermittant flow reversal occurring only upon acceleration. The muffler is formed with a plurality of longitudinal chambers divided by reflection walls. Edge echo openings in the reflection walls permit limited gas entry into the chambers. A plurality of helical members surrounded by a large open tube and pierced by a small open tube channel all of the gases through a bulkhead wall which divides the muffler housing into two volumetrically generally equal portions.

11 Claims, 13 Drawing Figures

ENGINE EXHAUST MUFFLER

BACKGROUND OF THE INVENTION

This invention relates to mufflers for internal combustion engines mounted in automobiles, trucks and stationary engines.

This muffler resulted from a need for a muffler short enough to fit foreign and domestic vehicles where space requirements were limited.

A need existed to reduce hesitation during acceleration due to sudden back pressure buildup.

Our engine exhaust muffler disclosed in U.S. Pat. No. 4,307,502 granted Mar. 2, 1982, when shortened was too loud and did not meet state requirements. Further, the helical member, is expensive and there was a need to reduce the overall cost of the muffler. Merely shortening the helical members resulted in objectionable noise levels.

SUMMARY OF THE INVENTION

The present muffler is shorter than comparable models of the muffler disclosed in U.S. Pat. No. 4,307,502, supra, yet the silencing levels are comparable. The shorter muffler can be fitted to most all of the smaller compact cars.

The present invention uses a helical member which is shorter than the muffler disclosed in U.S. Pat. No. 4,307,502, supra.

The present invention provides a structure which avoids excessive pressure buildup under rapid acceleration operating conditions.

The present invention provides a structure which reduces back pressure to an even greater extent than the muffler described in our U.S. Pat. No. 4,307,502, supra.

The present invention produces a variety of harmonic sounds and overtones resulting in a quality of sound that is more pleasing.

Uncapping the small tube in U.S. Pat. No, 4,307,502 eliminated objectionable high frequency tones.

DESCRIPTION OF THE INVENTION

Figure 1:
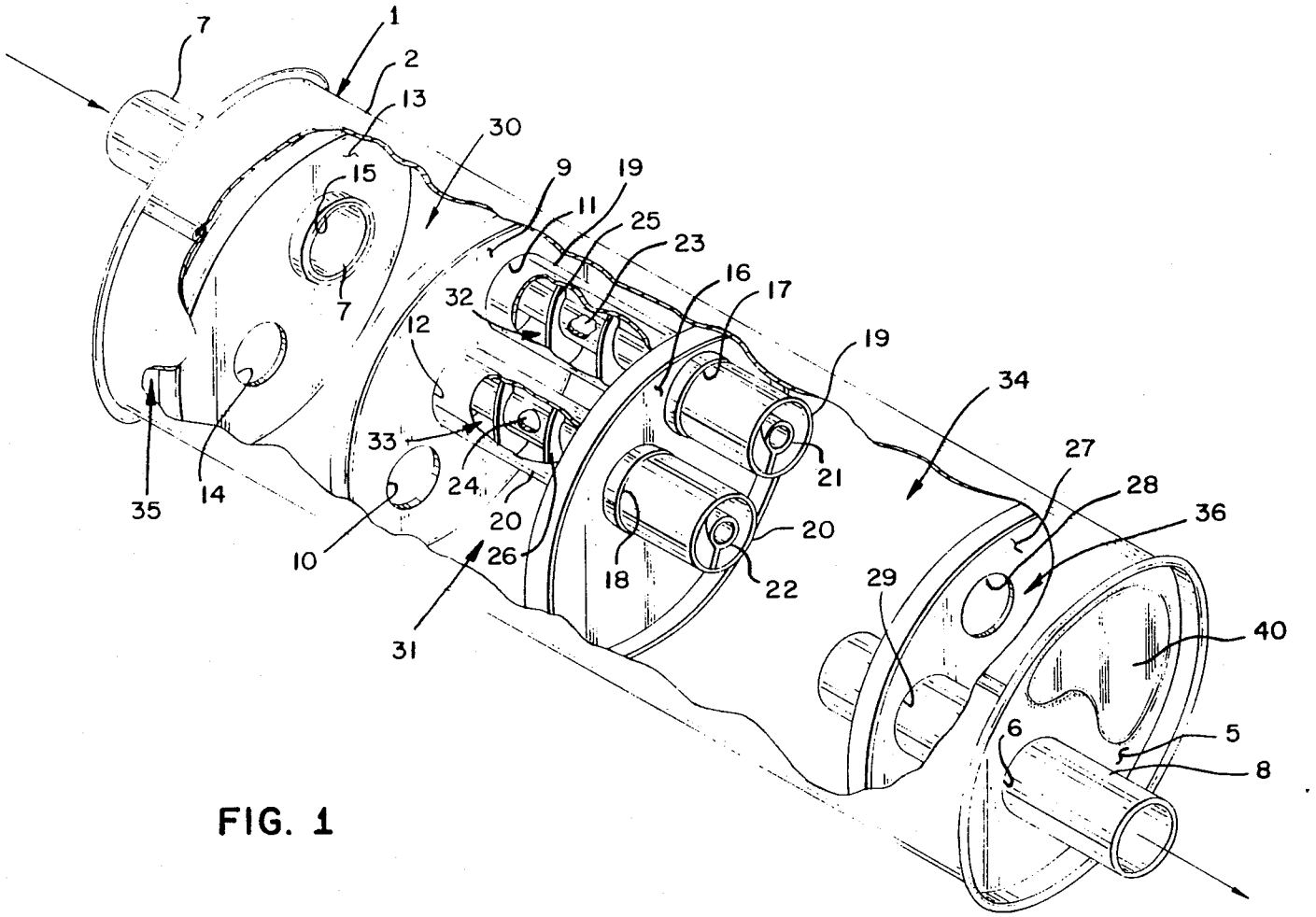
FIG. 1 is a perspective view of the muffler of the present invention with portions cut away for purposes of illustration.
Figures 2, 3, 4, 5:
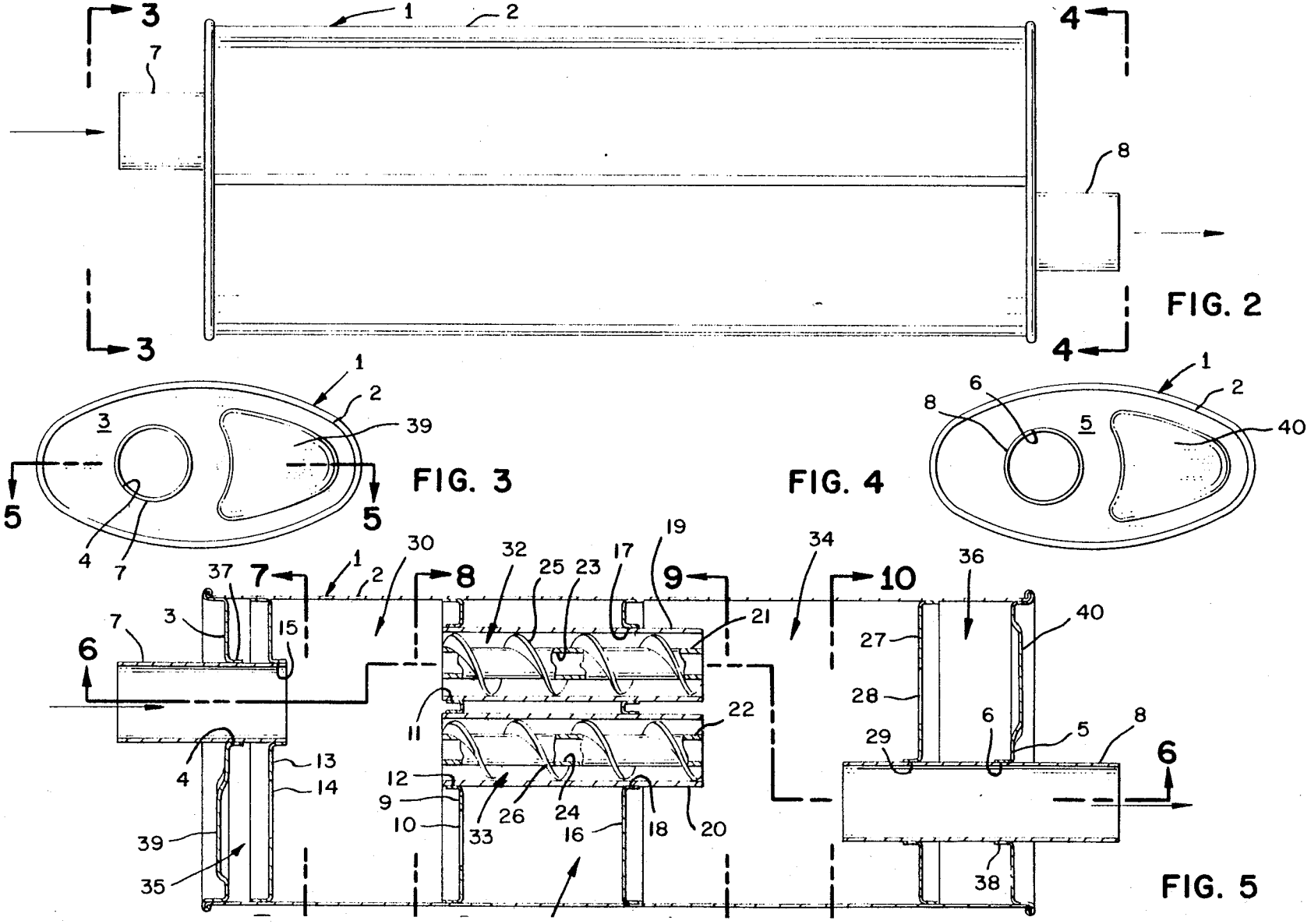
FIG. 2 is a top plan view of the muffler shown in FIG. 1.
FIG. 3 is a front end view of the muffler shown in FIG. 2 taken along lines 3—3.
FIG. 4 is an end view of the discharge end of the muffler shown in FIG. 2 and taken along line 4—4.
FIG. 5 is a cross sectional view of the muffler taken generally along line 5—5 of FIG. 3 with selected portions cut away for purposes of clairity.
Figure 6:
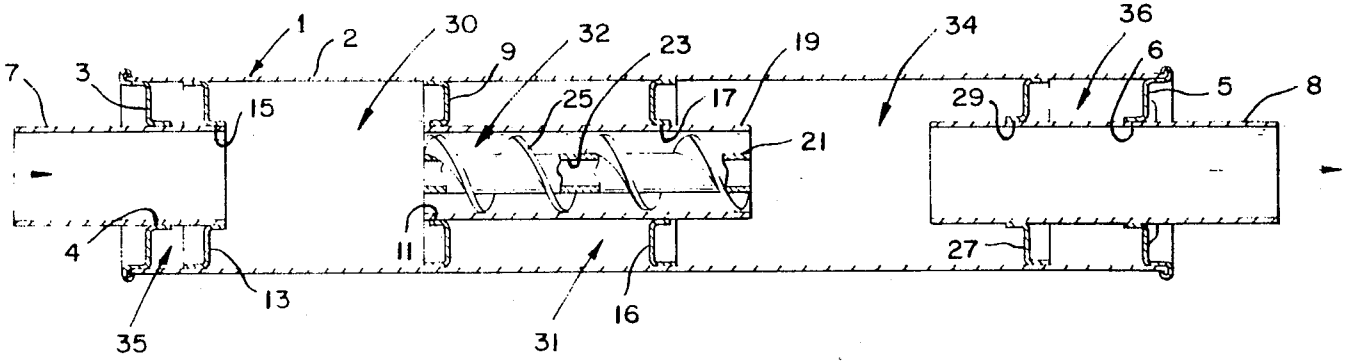
FIG. 6 is a cross sectional view of the muffler taken along line 6—6 of FIG. 5.
Figure 8:
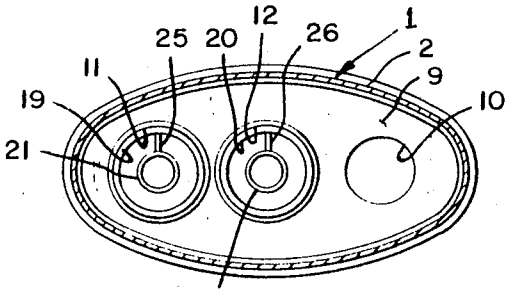
FIG. 8 is a cross sectional view of the muffler taken along line 8—8 of FIG. 5.
Figure 10:
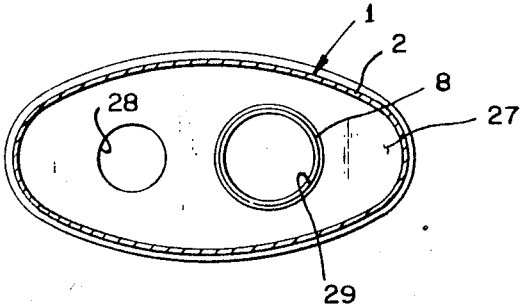
FIG. 10 is a cross sectional view of the muffler taken along line 10—10 of FIG. 5.
Figure 7:
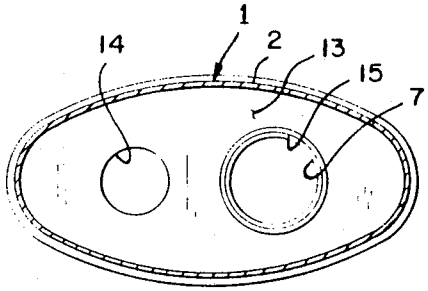
FIG. 7 is a cross sectional view of the muffler taken along line 7—7 of FIG. 5.
Figure 9:
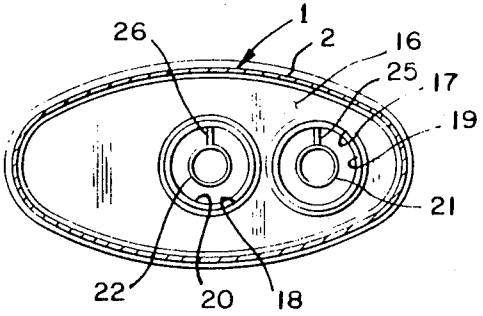
FIG. 9 is a cross sectional view of the muffler taken along line 9—9 of FIG. 5.

The muffler of the present invention is constructed so that the exhaust gases from an internal combustion engine travel from the upstream side of the muffler to the downstream side in generally the same direction as contrasted with standard mufflers in which a series of baffles cause the exhaust gases to follow a tortuous route, changing direction several times and even traveling in the opposite direction. The muffler thus has some of the characteristics of a performance muffler in so far as single direction flow is concerned but without the sound absorbent materials which cause moisture to condense within the muffler and result in damaging rusting.

The present muffler was designed to create as little back pressure as possible and still reduce the sound level within required limits while creating a sound which is not objectionable. The structure used to reduce the sound level and create a pleasing type sound greatly affect the back pressure problem. Back pressure and sound level are both measureable, but type of sound is purely subjective.

The present muffler reduces back pressure appreciably over standard mufflers and meets all state sound level requirements. The type of sound emitted by the muffler is very unique and has been found to be highly acceptable to substantially everyone.

The type of sound of the present muffler may be described as having a deep throaty reverberating tone which is probably caused by the reflecting walls and the mixing of the swirling gases imparted by the helixes and the direct pulsing gases emitting from the inner small tubes. The deeper tones probably result from the oversize chambers. The sound is found to be pleasant because there is a multiplication of different frequencies resulting in a harmonic blending with the fundamental tones passing through the inner small tubes. The multiple frequencies are believed to result from passage of the pulsating exhaust through the helical swirl chambers and passage of exhaust through the multiple echo hole openings in the internal walls.

While achieving low back pressure, acceptable sound levels and a pleasant harmonic sound, an unexpected operational performance was achieved. Most of us accept a short delay between pedal pressure on the accelerator and the resulting acceleration. In auto racing, however, this delay can mean the difference between winning and losing a race. While racing Porches with Applicants' patented muffler U.S. Pat. No. 4,317,502 supra installed, the driver experienced the exhilaration of being able to pull away from the pack on the straightaways but after slowing for the turns, he experienced some pause in acceleration coming out of the turns which caused him to lose one or more places. After installing the present muffler, the same performance was attained in the straightaways but the virtual elimination of the lag in accelerating out of the curves was so much improved that the driver no longer found himself losing places coming out of the turns. The use of chambers which we have labeled acceleration expansion chambers is probably the reason for the virtual elimination of lag in acceleration. These chambers appear to permit immediate expansion of gases within the muffler to reduce the buildup of power robbing back pressure.

The internal combustion engine muffler of the present invention consists of an elongated housing 1 having a curvilinear side wall 2, an inlet end wall 3 formed with a first inlet opening 4, and an outlet end wall 5 formed with a first outlet opening 6; an inlet tube 7 connected to the inlet end wall and communicating with the first inlet opening in the inlet end wall; an outlet tube 8 connected to the outlet end wall and communicating with the first outlet opening in the outlet end wall; a first internal reflection wall 9 axially spaced downstream from the inlet end wall forming a close fit with the curvilinear side wall and formed with a first edge echo opening 10 therethrough and first and second large tube openings 11 and 12; a second internal reflection wall 13 spaced between the inlet end wall and the first internal reflection wall forming a close fit with the curvilinear side wall and forming with a second edge echo opening 14 therethrough and a second inlet tube opening 15; the inlet tube communicates with the second inlet tube opening in the second internal reflection wall and is connected to the second internal reflection wall; a bulkhead wall 16 axially spaced downstream from the first internal reflection wall forming a close fit with the curvilinear side wall and formed with third and fourth large tube openings 17 and 18 axially aligned with the first and second large tube openings in the first internal reflection wall; first and second elongated internal large tube members 19 and 20 connected to and extending from the first internal reflection wall to the bulkhead wall and communicating with the large tube openings in the first internal reflection wall and the bulkhead, and connected to the bulkhead wall; first and second inner small tube members 21 and 22 coaxially mounted within the first and second large tubes forming first and second open ended pulse chambers 23 and 24; first and second elongated helical members 25 and 26 joining the first and second inner small tubes and the first and second internal large tube members; a third internal reflection wall 27 axially spaced downstream from the bulkhead wall forming a close fit with the curvilinear side wall and formed with a third edge echo opening 28 therethrough and a second outlet tube opening 29 formed in alignment with the outlet opening in the outlet end wall; the outlet tube is in communication with the second outlet tube opening in the third internal reflection wall, and is connected to the third internal reflection wall; a primary expansion chamber 30 is formed by the curvilinear side wall, the second internal reflection wall and the first internal reflection wall; a primary acceleration expansion chamber 31 is formed by the curvilinear side wall, the first internal reflection wall and the bulkhead wall; first and second elongated swirl and pulse smoothing chambers 32 and 33 are formed between the first and second inner small tubes and the internal large tubes and divided by the helical members; and a primary interference chamber 34 is formed by the curvilinear side wall, the bulkhead wall and the third internal reflection wall; a second acceleration expansion chamber 35 formed by the curvilinear side wall, the inlet end wall, and the second internal reflection wall; and a third acceleration expansion chamber 36 is formed by the curvilinear side wall, the third internal reflection wall and the outlet end wall.

The actual lengths of the first and second internal large tubes, the first and second helical members and first and second inner small tubes may vary. It has been found, however, that if the length of the foregoing elements are co-extensive in length and their ends are substantially coterminus, an optimum muffler is obtained.

As shown in the drawing, the ends of the above elements extend a substantially distance downstream of the bulkhead member. The distance may be varied, but again a substantial distance results in a satisfactory muffler.

The outlet tube length extends a substantial distance upstream beyond the outlet end wall. It has been found that as this distance becomes shorter, the noise level increases.

The bulkhead wall plays a major roll in the satisfactory performance of the muffler. The exact location is not critical, but an optimum working muffler appears to result when the bulkhead is located at the mid-portion of the housing.

The alignment of the inlet tube, small inner tubes and outlet tube may vary. It has been discovered, however, that satisfactory operation may be achieved even when the aforesaid tubes are in substantial alignment. This fact can be readily observed by actually looking through either end of the muffler and seeing completely through the muffler.

The present muffler may have various shapes but an oval appears to operate optimally.

The present muffler may be formed so that the inlet tube enters the inlet end wall at a location offset to the center of the wall and the outlet tube also is located at a position offset to the center of the outlet wall.

It has been found that the muffler operates satisfactorily when the outlet tube is centered in the outlet wall. Such positioning makes it possible to add another echo edge opening in the third internal reflection wall.

Figure 11:
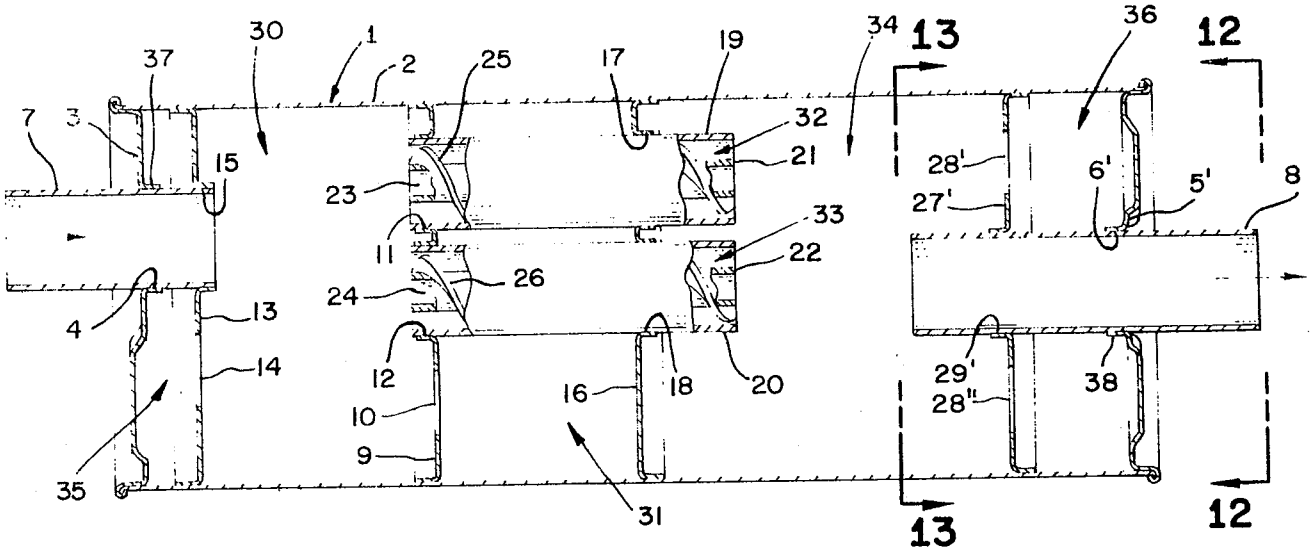
FIG. 11 is a cross sectional view of a modified form of the invention in which the illustration is similar to the view taken in FIG. 5.
Figure 13:
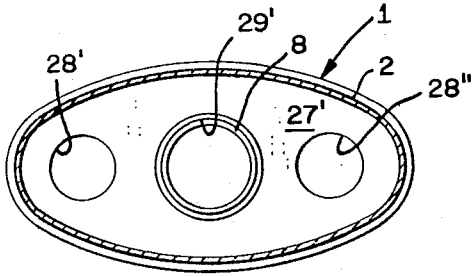
FIG. 13 is a cross sectional view of the muffler taken along line 13—13 of FIG. 11.
Figure 12:
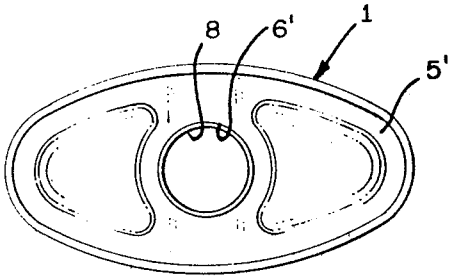
FIG. 12 is an end view of the muffler illustrated in FIG. 11 taken generally along line 12—12.

Thus, as shown in FIGS. 11, 12 and 13, the outlet end wall 5' is formed with first center outlet opening 6'. Third reflection wall 27' is formed with third edge echo opening 28' and a fourth edge echo opening 28''. The inner end of the outlet tube is held by center opening 29' in the third internal reflection wall.

Construction of the sidewalls of the muffler are 18 gauge double-wrapped; inner galvanized to inhibit acid and water corrosion with an outer wrap of aluminum clad steel to inhibit road salt corrosion.

The end walls are 18 gauge aluminum killed deep drawing quality metal formed with inlet and outlet nipples 37 and 38. Deformations 39 and 40 are formed in the end walls to provide strength and to reduce the drum effect of planar end walls.

Inlet and outlet nipples may be pressed, fitted and machine spot welded with hand held wire weld to each end wall; top and bottom for secure fitting.

Inlet and outlet nipples may also be press fitted to the internal reflection walls and bulkhead. The press fittings allow for heat expansion and contraction without stress.

Pressed and rolled seams, not crimped, should be provided for durability and to withstand the pressure of backfires.

Since there are no closed chambers, moisture collection and "rust-out" are inhibited. No drain holes need be provided. It has been found that the muffler heats up uniformly within a few minutes of operation so there are no hot or cold spots where moisture collects or vaporizes. The auger assemblies are 18 gauge.

It has been found that an inventory of 18 different mufflers is suitable to cover the needs of a muffler shop. Housing lengths of 15" and 20", oval sizes of $4\frac{1}{4}'' \times 8\frac{1}{2}''$ and $4\frac{1}{2}'' \times 10\frac{1}{2}''$ and outlet tubes offset and centered provide the only differences. The internal construction is the same for all mufflers except for different internal wall sizes to fit the two different size ovals.

The inlet and outlet tubes are welded to one end wall or internal wall only. Thus expansion and contraction of the exhaust system longitudinally will not break the welds.

The large tube members also are welded to one internal wall. The tubes are preferably 7" in length with an outside diameter of 2". The tubes are preferably 16 gauge. The helical auger may be formed with a 2" pitch and both ends are welded to both the inner small tube members and the large tube members. The auger is sized to fit snugly between the two tubes.

The inner small tube members are 7" long and have an outside diameter of 13/16".

The three internal reflection walls and the bulkhead wall are preferably formed with perimeter flanges and are spot welded to the inner wrapper.

DUALS

Engines with large displacement are difficult to quiet. Each opening of the exhaust valves to each cylinder releases a relatively large volume of gases resulting in a loud sound.

Such large displacement engines usually require two mufflers to cool the exhaust and dissipate the large volume of gases.

The present muffler with its low back pressure is ideally suited for dual muffler installations.

In placing duals on a big V-8, four cylinders are connected to each muffler. Since fewer cylinders attached to a muffler increases noise, it is necessary to decrease the helix diameter to obtain suitable noise levels. The auger size was reduced to $1\frac{5}{8}''$ and $1\frac{7}{8}''$.

The oval size was increased in the dual muffler format.

TURBO

The present muffler with its reduced back pressure has been found ideal for turbo equipped engines. The lower back pressure increases the pressure difference across the turbine therefore increasing the efficiency of the turbine. Standard mufflers which reverse the gas flow two or moe times have a back pressure of between 5 and 7 pounds per square foot. The present muffler, with its generally straight through flow has a back pressure of between two and four pounds per square foot. Some truck operators have experienced an increase of four to five miles per gallon over standard mufflers. In general, the present muffler results in an increase in gas mileage between 5 and 25% depending on the type of vehicle and type of use.

Examples of automobiles experiencing increased gasoline mileage using the present muffler as compared with a standard muffler are as follows.

A 1979 V-8 Mustang with an average of 24.9 miles per gallon was increased 5%. A 1975 V-6 Mustang with an average 17.0 miles per gallon was increased 17%. A 1975 Dodge Polara V-8 with 19.0 miles per gallon average was increased 14%. A 1967 Ford Galaxie V-8 with 14.9 miles per gallon was increased 20%. A 1981 Olds Toronado V-8 with 10.0 miles per gallon average was increased 23%. A 1977 Ford LTD wagon V-8 with an 8.5 miles per gallon average was increased 25%.

Operation of the muffler resulting in better acceleration is as follows: When an engine is accelerating in speed, higher pressures and a greater volume of exhaust gas is generated. The hot exhaust gases enter the muffler through inlet tube 7 and first pass in a series of rapid pulses into primary expansion chamber 30. The rapid buildup in pressure immediately causes an increase in pressure and flow through both of the pulse chambers 23 and 24 and both the swirl and pulse smoothing chambers 32 and 33. Without the possibility of dissipating the pressure, back pressure would increase and acceleration would be retarded as in a standard muffler and in the muffler set forth in U.S. Pat. No. 4,317,502 and all other mufflers known. The present muffler is provided with a primary acceleration expansion chamber 34 which permits a further pressure buildup in a relatively large chamber. Pressure buildup is also permitted in a second acceleration expansion chamber 35. Some pressure build up also occurs in the primary interference chamber 34 and in the third acceleration expansion chamber 36.

The dissipation of pressure in the large chambers results in a reduction of sound level. Instead of the hot gases suddenly striking a metal surface, the gases entering the large primary expansion chamber strike a volume of hot air before contacting the reflection wall 9. Further, because the pressure is quickly dissipated, the hot gases strike a volume of gases under lower pressure. In like manner, the gases discharging from chambers 23, 24, 32 and 33 strike a large volume of gases which are cooling in chamber 34 before striking wall 27.

Noise level at start-up is greatest in most automobiles. This results from hot gases from the engine striking cold air in the muffler. In standard mufflers, the noise level is not abated until the entire muffler is heated. In the present muffler, heating is in two stages so the muffler noise is abated within a shorter time and finally is further quieted as the entire muffler is heated. Two stage heating results from the construction of the muffler in two nearly equal volumes separated by bulkhead wall 16.

All of the hot gases from the engine are initially forced into the primary expansion chamber 30, the primary accelleration expansion chamber 31 and the second accelleration expansion chamber 35. The initial warm-up of the upstream half of the muffler quickly reduces the temperature differential between the entering engine gases and the temperature of the gas in the muffler thereby quickly quieting the exhaust sound. As the engine continues to operate, the chambers on the downstream side of the bulkhead wall warm up and the temperature tends to equalize.

Sound level is largely a function of the ability of the muffler to convert rapid impulses of high pressure hot gases to a smooth non-pulsing flow of cooler gases to the cooler atmospheric air. This is accomplished in the following manner. All of the chambers set forth above permit expansion and cooling of the gases.

Gases flowing through the swirl and pulse smoothing chambers 32 and 33 cause a rapid dissipation of the pressure pulses.

Sound level is also decreased by a mixing of the pulsing gases by what is known as interference of sound waves. This interference phenomenon occurs primarily in primary interference chamber 34. Gases discharges from the swirl and pulse smoothing chambers 32 and 33 are caused to swirl by the helix members. These swirling gases mix with more rapidly moving gases being dicharged through pulse chambers 23 and 24.

Of course, pressure pulses are removed by the reflection of the gases between the reflection walls of each of the chambers.

Some further noise reduction occurs at each of the edge echo openings by a phenomenon known as "echo" caused by the gases attempting to pass by the sharp edges of a narrow opening between two large chambers. The edges cause a compression of the gases resulting in a change in frequency of the pressure waves thereby resulting in interference and canceling of the sound waves.

Finally, all noises are more easily tolerated if the sound is a blend of harmonics. Just as an ochestra playing discordant sounds can sound very irritating and an orchestra with the various instruments playing in harmony can sound very good even though still playing loud; so too a muffler emitting harmonic sounds, sounds less irritating than one sounding one or more loud discordant sound frequencies.

In the present muffler, the various parts are "tuned" to produce harmonic sound frequencies. These different sounds are produced by various elements in the muffler. First, the hot gases discharging from inlet pipe 7 into primary expansion chamber 30 create a sound at a relatively low frequency. Gases passing echo edge opening 10 create a high frequency sound. Gases entering at a lower velocity into large primary accelleration expansion chamber 31 create a low frequency sound. Gases passing echo edge opening 14 into small second accelleration expansion chamber create a high frequency sound. The gases passing into the small chamber 35 strike the inlet end wall and create a medium frequency tone.

Gases passing through the swirl and impulse smoothing chambers 32 and 33 create a plurality of sounds at different frequences as they pass through the helical members. At the same time, the inner small tubes 21 and 22 create a fundamental tone.

The passing of the swirling gases and the direct impulse gases from the small tubes 21 and 22 mix in the primary interference chamber and break up into a multiplicity of sounds. Of course, the echo edge opening 28 creates a high frequency sound and a low frequency sound is created in the third accelerating chamber 36.

Reverberation takes place in all of the chambers and even the length of outlet tube extending into chamber 34 affects the noise level.

The following quotation is taken from *Mechanical Engineers' Handbook,* Lionel S. Marks, 5th ed., McGraw Hill Book Co., Copyright 1951.

> "Exhaust back pressure should be kept to a minimum since an increase of 1 psi in back pressure decreases the maximum power output about 2½ percent, about 1 percent being due to more exhaust work and the balance to the effect of increased clearance gas pressure on volumetric efficiency."

In the present muffler, the combined cross sectional area of the first and second inner small tube members 21 and 22 and the open area between the first and second large tube members 19 and 20 and the small tube members 21 and 22 is greater than either of the individual cross sectional areas of inlet tube 4 and outlet tube 6. Because of this relationship there is no restricting area within the muffler to cause further compression of the gases. This is contrary to standard mufflers which have constricting areas within the muffler.

We claim:

1. An internal combustion engine muffler comprising:

a. an elongated housing having a curvilinear side wall, an inlet end wall formd with a first inlet opening, and an outlet end wall formed with a first outlet opening;

b. an inlet tube connected to said inlet end wall and communicating with said first inlet opening in said inlet end wall;

c. an outlet tube connected to said outlet end wall and communicating with said first outlet opening in said outlet end wall;

d. a first internal reflection wall axially spaced downstream from said inlet end wall forming a close fit with said curvilinear side wall and formed with a first edge echo opening therethrough and first and second large tube openings;

e. a second internal reflection wall spaced between said inlet end wall and said first internal reflection wall forming a close fit with said curvilinear side wall and formed with a second edge echo opening therethrough and a second inlet tube opening;

f. said inlet tube communicates with said second inlet tube opening in said second internal reflection wall and is connected to said second internal reflection wall;

g. a bulkhead wall axially spaced downstream from said first internal reflection wall forming a close fit with said curvilinear side wall and formed with third and fourth large tube openings axially aligned with said first and second large tube openings in said first internal reflection wall;

h. first and second elongated internal large tube members connected to and extending from said first internal reflection wall to said bulkhead wall and communicating with said large tube openings in said first internal reflection wall and said bulkhead, and connected to said bulkhead wall;

i. first and second inner small tube members coaxially mounted within said first and second large tubes forming first and second open ended pulse chambers;

j. first and second elongated helical members joining said first and second inner small tubes and said first and second internal large tube members;

k. a third internal reflection wall axially spaced downstream from said bulkhead wall forming a close fit with said curvilinear side wall and formed with a third edge echo opening therethrough and a second outlet tube opening formed in alignment with said first outlet opening in said outlet end wall;

l. said outlet tube is in communication with said second outlet tube opening in said third internal reflection wall, and is connected to said third internal reflection wall;

m. a primary expansion chamber formed by said curvilinear side wall, said second internal reflection wall and said first internal reflection wall;

n. a primary acceleration expansion chamber formed by said curvilinear side wall, said first internal reflection wall and said bulkhead wall;

o. first and second elongated swirl and pulse smooting chambers formed between said first and second inner small tubes and said internal large tubes and divided by said helical members;

p. a primary interference chamber formed by said curvilinear side wall, said bulkhead wall and said third internal reflection wall;

q. a second acceleration expansion chamber formed by said curvilinear side wall, said inlet end wall, and said second internal reflection wall; and r. a third acceleration expansion chamber formed by said curvilinear side wall, said third internal reflection wall and said outlet end wall.

2. A muffler as described in claim 1 comprising:

a. said first and second internal large tubes, said first and second inner small tubes and said first and second helical members are substantially co-extensive in length and their ends are substantially coterminus.

3. A muffler as described in claim 2 wherein:

a. said ends of said internal large tubes extend a substantial distance beyond said bulkhead member.

4. A muffler as described in claim 3 wherein:

a. said outlet tube extends a substantial distance upstream beyond said outlet end wall.

5. A muffler as described in claim 1 wherein:

a. said bulkhead wall is located at substantially the mid-portion of said housing.

6. A muffler as described in claim 1 wherein:

a. said inlet tube, one of said inner small tubes and said outlet tube are substantially in alignment.

7. A muffler as described in claim 4 wherein said housing is oval in shape.

8. A muffler as described in claim 1 wherein:

a. said inlet tube is offset from the center of said inlet end wall; and b. said outlet tube is offset from the center of said outlet end wall.

9. A muffler as described in claim 1 wherein:

a. said inlet tube is offset from the center of said inlet end wall; and b. said outlet tube is substantially centered in said outlet end wall.

10. A muffler as described in claim 9 wherein:

a. said third internal reflection wall is formed with at least two echo edge openings therethrough.

11. A muffler as described in claim 1 wherein:

a. the combined open areas of said first and second inner small tube members and the open area between said first and second inner tubes and said first and second internal large tube members is greater than either of the individual respective area of said inlet tube and said outlet tube.

* * * * *